United States Patent [19]

Rabe

[11] Patent Number: 5,073,997

[45] Date of Patent: Dec. 24, 1991

[54] BUILT-IN SINK

[75] Inventor: Wulf Rabe, Lathi, Finland

[73] Assignee: Stala Oy, Lahti, Finland

[21] Appl. No.: 487,725

[22] Filed: Mar. 5, 1990

[30] Foreign Application Priority Data

Mar. 16, 1989 [DE] Fed. Rep. of Germany ..... 3908595

[51] Int. Cl.[5] ..... E03C 1/00; A47B 77/06

[52] U.S. Cl. ..... 4/629; 4/637; 4/641; 4/642; 312/22; 312/228

[58] Field of Search ..... 4/629–631, 4/637, 661, 639, 640, 638, 654, 655, 656, 657, 641, 642; 312/22, 228, 282

[56] References Cited

U.S. PATENT DOCUMENTS

| | | | |
|---|---|---|---|
| 858,628 | 7/1907 | Ross | 4/630 |
| 2,222,960 | 11/1940 | Strachan | 4/630 X |
| 2,908,019 | 10/1959 | Lyon, Jr. | 4/631 |
| 3,983,583 | 10/1976 | Harman et al. | 4/630 X |
| 3,993,376 | 11/1976 | Meldahl | 312/228 |
| 4,305,166 | 12/1981 | Rose | 4/637 X |
| 4,456,021 | 6/1984 | Leavens | 4/630 X |
| 4,847,927 | 7/1989 | Blanc | 4/629 |

FOREIGN PATENT DOCUMENTS

| | | | |
|---|---|---|---|
| 805299 | 5/1951 | Fed. Rep. of Germany | 4/639 |
| 8408441 | 9/1981 | Fed. Rep. of Germany . | |
| 3535422 | 10/1987 | Fed. Rep. of Germany . | |
| 2415445 | 8/1979 | France . | |

*Primary Examiner*—Henry J. Recla
*Assistant Examiner*—Robert M. Fetsuga
*Attorney, Agent, or Firm*—Spencer & Frank

[57] ABSTRACT

A built-in sink including at least one wash basin (16) and at least one garbage chute (28, 30) is provided with a cover plate (40, 42) which is fastened to the sink so as to be laterally displaced or folded into a position next to the sink. The cover plate may be divided into two halves (40, 42) which are pushed together toward the center over the sink and the garbage chutes.

6 Claims, 6 Drawing Sheets

BUILT-IN SINK

BACKGROUND OF THE INVENTION

The invention relates to a built-in sink including at least one wash basin, at least one garbage chute and a cover plate.

Built-in sinks are known in numerous embodiments. In more recent embodiments, the sinks have one or two wash basins and frequently also a garbage chute which opens into a garbage can disposed directly below the sink. There are also built-in sinks having two garbage chutes which are associated with two separate garbage cans and allow the separation of certain types of garbage, for example compostable garbage, from the remainder of the garbage. Generally, loose covers that are placed onto the chutes are provided to close the garbage chutes. Moreover, generally a drip surface is disposed on one or the other side of the sink or sinks and garbage chutes. Furthermore there exist cover plates which are adapted to the shape of the wash basin or basins and can be placed on top of these wash basins. Such cover plates may perform various functions, for example that of a cutting board, a sieve plate, a drip plate or the like.

Regarding prior art, reference is made to DE-GM 84 08 441, German Patent No. 3,535,422, French Patent No. 2,415,445 as well as brochures by Villeroy & Boch, Mettlach; Franke, Bad Säckingen and Blanc, Oberderdingen.

The prior art built-in sinks equipped with garbage chutes have the drawback that the customary plate for closing the garbage chute covers only the chute itself and not its environment. However, generally this environment is soiled when garbage is thrown into the chute and this refuse must then be removed each time the kitchen is to be brought into an orderly state whenever kitchen work is temporarily interrupted. The same applies for the edges of the wash basins which are also not covered by the prior art cover plates. These prior art cover plates for the wash basins and the covers for the garbage chutes have the further drawback that they constitute separate parts which must be put aside when the wash basins and the garbage chutes are being used. However, generally no suitable space is available for the storage of these plates so that they are deposited at various locations on the counter top or on a kitchen table and further limit the usually tightly dimensioned work area.

SUMMARY OF THE INVENTION

It is the object of the invention to provide a built-in sink which, after use, can be covered completely in a simple manner, and without involving separate components that must be separately stored when not in use.

As a solution of the problem at hand, the built-in sink according to the invention is characterized in that the cover plate is divided into two cover plate halves which are guided with the aid of guide members and guide rails and are laterally displaceable into a position next to the sink.

The cover plate may also be pushed, for example, longitudinally from one side of the sink completely over all wash basins and garbage chutes so that all basins and chutes are then covered. This makes it possible to easily put the sink into an orderly state even for only a short interruption of kitchen work and thus also accommodate dirty dishes in the wash basin without having first to perform much cleaning work.

In connection with the present invention, the longitudinal direction of a built-in sink is understood to mean the direction of the associated counter top, that is the direction transverse to the user.

Preferably, the cover plate is divided transversely to the longitudinal direction in the region of the customary faucet assembly. The faucet assembly may be accommodated in the two halves of the cover plate by way of corresponding cutouts. When the built-in sink is opened, these two halves are pulled apart toward the two longitudinal directions of the built-in sink.

Preferably the cover plate is configured as a drip plate but may also be a sieve plate, a cutting board or the like.

The cover plate or the two cover plate halves are preferably guided on at least one guide member which extends in the longitudinal direction of the sink from its lateral edges. On the underside of the cover plate, there is disposed a guide rail which grips behind this guide member so that the cover plate is secured against lifting off and sliding out of place. Only in the completely pushed-together position, possibly also in another, defined position, can the cover plate be lifted out in order, for example, to clean from time to time the surface below the cover plate. In order to keep the guide member concealed at all times, the latter is relatively short while the guide rail extends essentially over the entire length of the cover plate and, in the longitudinal direction of the sink, the cover plate projects beyond the sink corresponding to the length of the rail.

DESCRIPTION OF THE PREFERRED EMBODIMENTS

Figure 1:
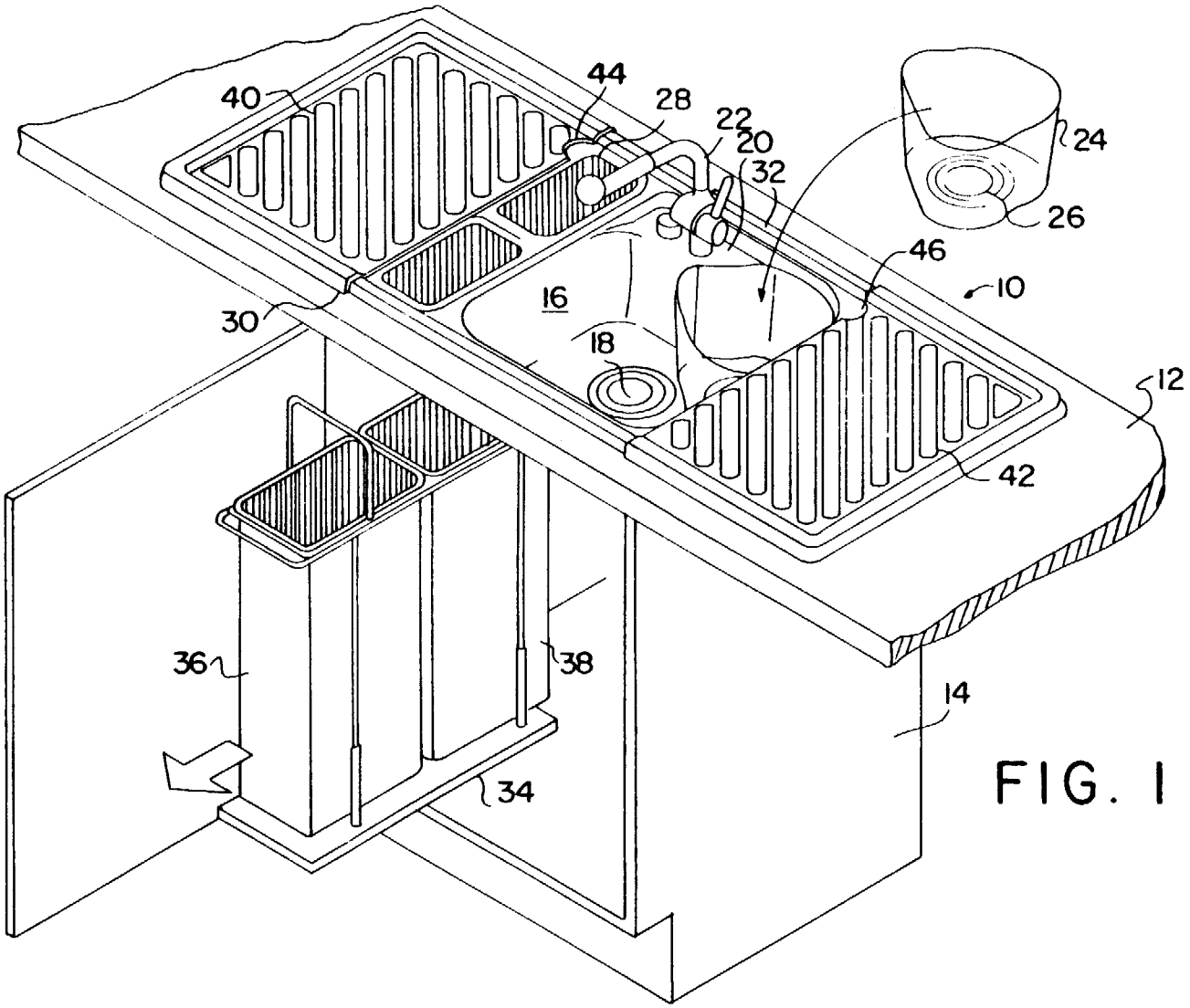
FIG. 1 is a perspective view of a preferred embodiment of a built-in sink according to the invention in an open position.

A built-in sink or sink unit 10 according to FIG. 1 is inserted in the usual manner into a counter top 12. Below the built-in sink and the counter top there is a base cabinet 14. The other configuration of the customary kitchen furnishings will not be discussed in detail here. The built-in sink 10 includes a wash basin 16 equipped with a drain 18. Wash basin 16 has an irregular shape and, in its rear region facing the kitchen wall (not shown), it is provided with an inwardly projecting pedestal 20 on which is mounted a faucet assembly 22. In the niche formed on the right in FIG. 1 next to pedestal 20, a secondary basin 24 is removably disposed and has its own drain 26 which is associated with a separate drain (not shown) in the bottom of the wash basin. Details of the wash basin are insignificant in the present context.

On the left next to wash basin 16, there are two garbage chutes 28, 30 for two different types of garbage. Wash basins 16, garbage chutes 28, 30 and pedestal 20 are enclosed by a continuous edge bead 32 which is shown only in part and serves as overflow protection and for stabilization.

In base cabinet 14 two garbage containers 36, 38 are disposed on a pull-out 34 in an arrangement one behind the other; when pull-out 34 is pushed in, the garbage containers lie below garbage chutes 28, 30.

In the longitudinal direction of the sink, here considered to be the longitudinal direction of counter top 12, the sink is extended by two halves 40, 42 of a cover plate which, in the illustrated example, is configured as a slightly inwardly sloping drip surface. In FIG. 1, the halves 40, 42 of the cover plate are in the outward end position in which they have been pulled out in the longitudinal direction of the built-in sink, while they are able, on the other hand, to take on the completely pushed-together position shown in FIG. 2 in which they cover the entire built-in sink. In order to accommodate the faucet assembly 22 in the position shown in FIG. 2, the two cover plate halves 40, 42 are given corresponding, semi-circular recesses 44, 46 at their facing edges.

Figure 2:
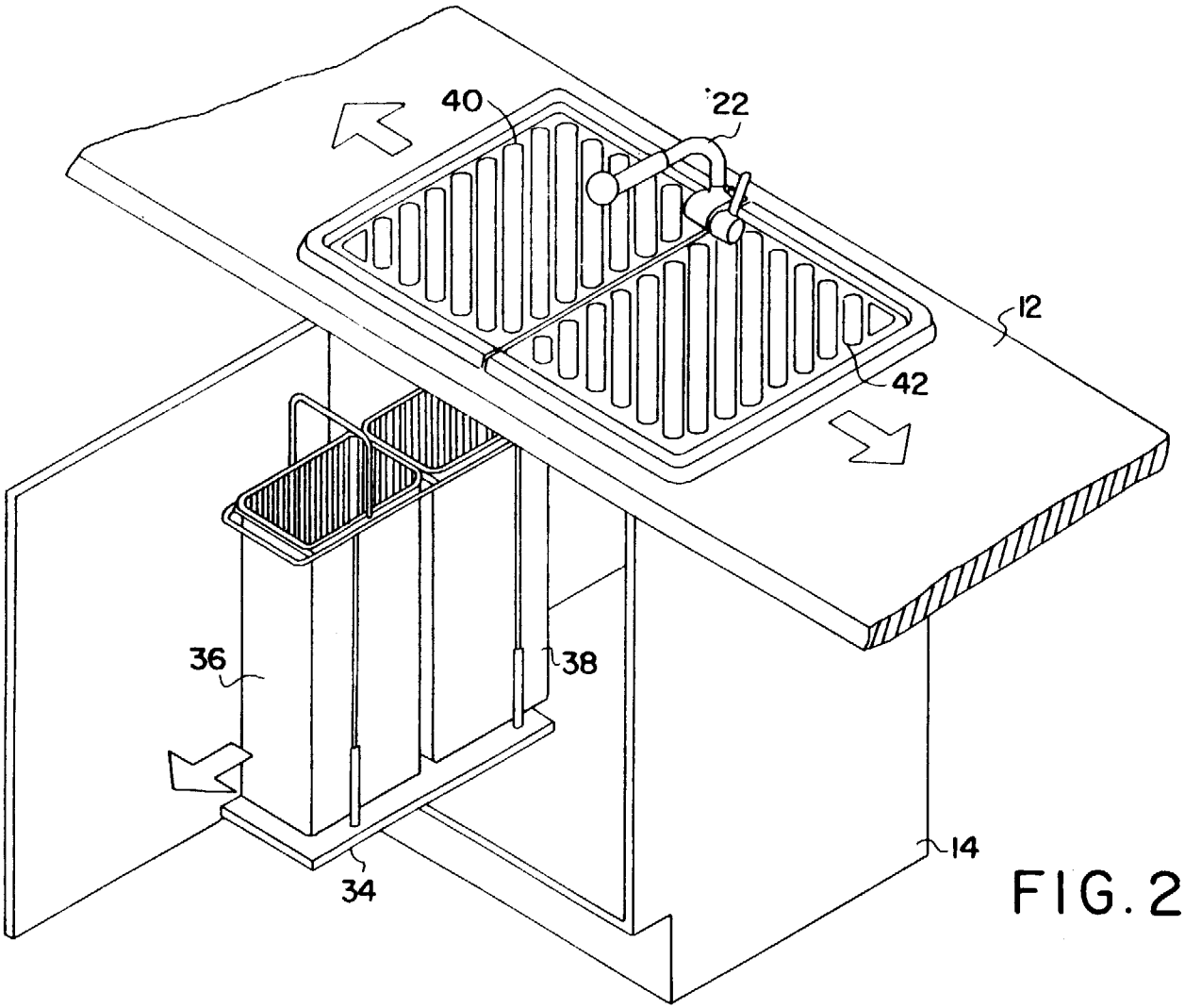
FIG. 2 is a perspective view of the built-in sink of FIG. 1 in the closed position.

In FIGS. 1 and 2, cover plate halves 40, 42 are provided with guides (shown in detail in FIGS. 5–7) which permit displacement between the two illustrated positions. These guides will be discussed in greater detail below.

Figure 3:
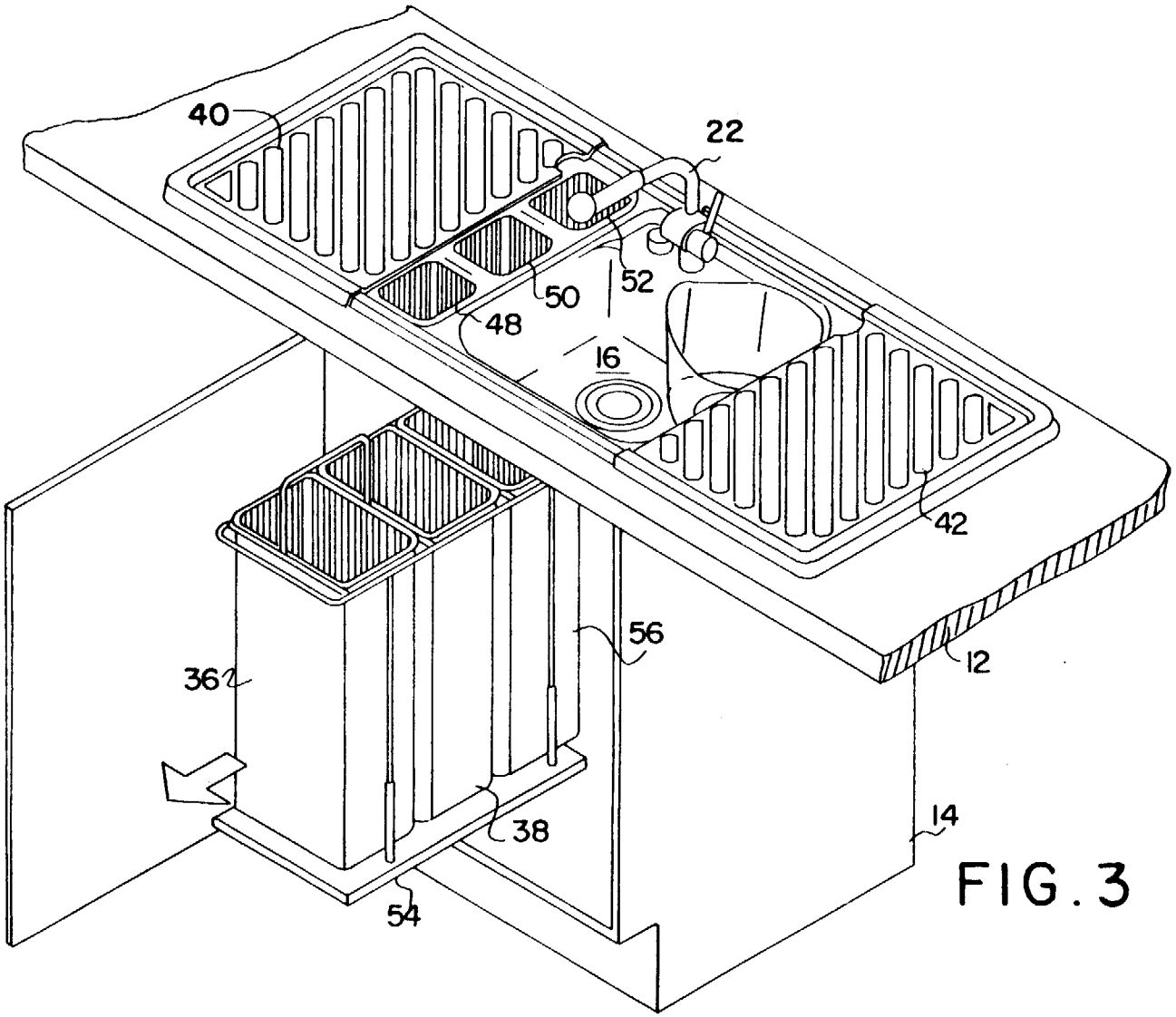
FIG. 3 shows another embodiment of the built-in sink.

FIG. 3 corresponds to FIG. 1 but, in contrast to FIG. 1, shows three separate smaller garbage chutes 48, 50, 52 for three different types of garbage. Base cabinet 14 is again provided with a pull-out 54 which in this case is broader than the above described pull-out 34 and holds in its transverse direction garbage containers 36, 38 as well as a further, identical garbage container 56, all having a rectangular cross section, so that now three garbage containers can be accommodated. It is therefore possible, depending on the customer's wishes, to provide two or three different garbage collection systems with the same garbage container and an interchangeable chute insert for the garbage chutes.

Figure 4:
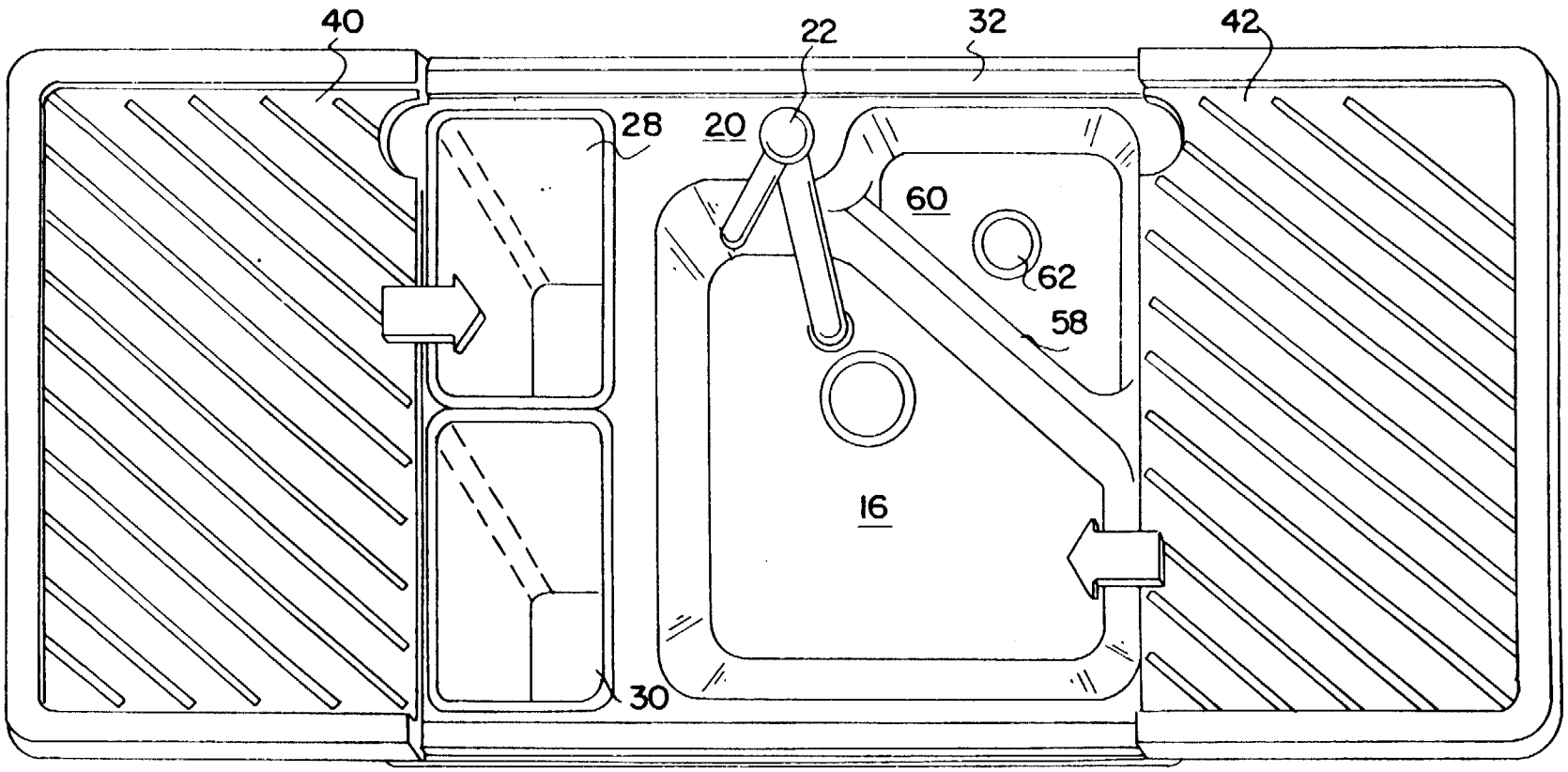
FIG. 4 shows a further embodiment of the built-in sink.

FIG. 4 is a top view of a built-in sink which essentially corresponds to that of FIG. 1. The embodiment shown here differs from that of FIG. 1 only in that, next to wash basin 16, in the mentioned niche next to pedestal 20, a secondary basin 60 with a separate drain 62 is permanently installed with the aid of a partition 58.

Number and configuration of the wash basins and garbage chutes should here be understood only as examples. The invention is primarily concerned with the coverage of the entire arrangement composed of wash basins and garbage chutes. Hereafter, the guide for displacing the cover plate halves 40, 42 will be described with reference to FIGS. 5 to 7.

Figure 5:
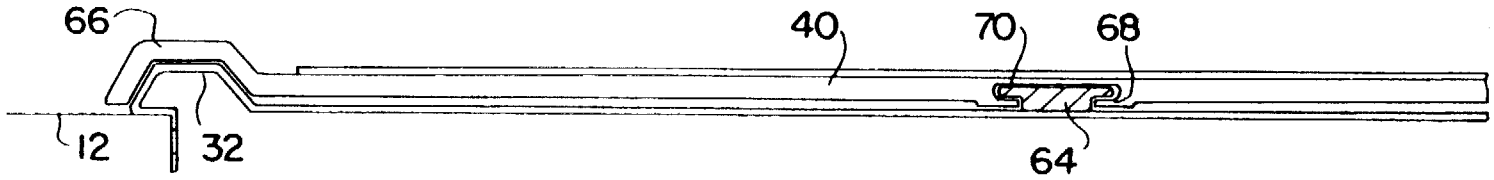
FIG. 5 is a partial cross-sectional view of the cover plate and its guide.

FIG. 5 is a partial cross-sectional view through the upper region of a wash basin, its edge bead and, moreover, a T-shaped rail 64 which is fastened in the longitudinal center line of the built-in sink outside of the region on counter top 12 taken up by the basins and the garbage chutes or to an edge strip of the sink which overlaps the counter top. At its outer edge shown on the left in FIG. 5, cover plate half 40 is provided with a convexly curved section 66 which is adapted in its cross-sectional configuration to edge bead 32 and passes over it. In its longitudinal center region, cover plate half 40 is provided with a guide rail 68 at its underside. If the cover plate is composed, for example, of plastic, this guide rail may be shaped directly into it or may be applied as a separate part to the lower surface. Guide rail 68 has a guide groove 70 which is undercut at both sides, has a T-shaped cross section and is adapted to the cross section of guide member 64. In this way, the cover plate half is simultaneously guided and secured against inadvertent removal.

Figure 6:
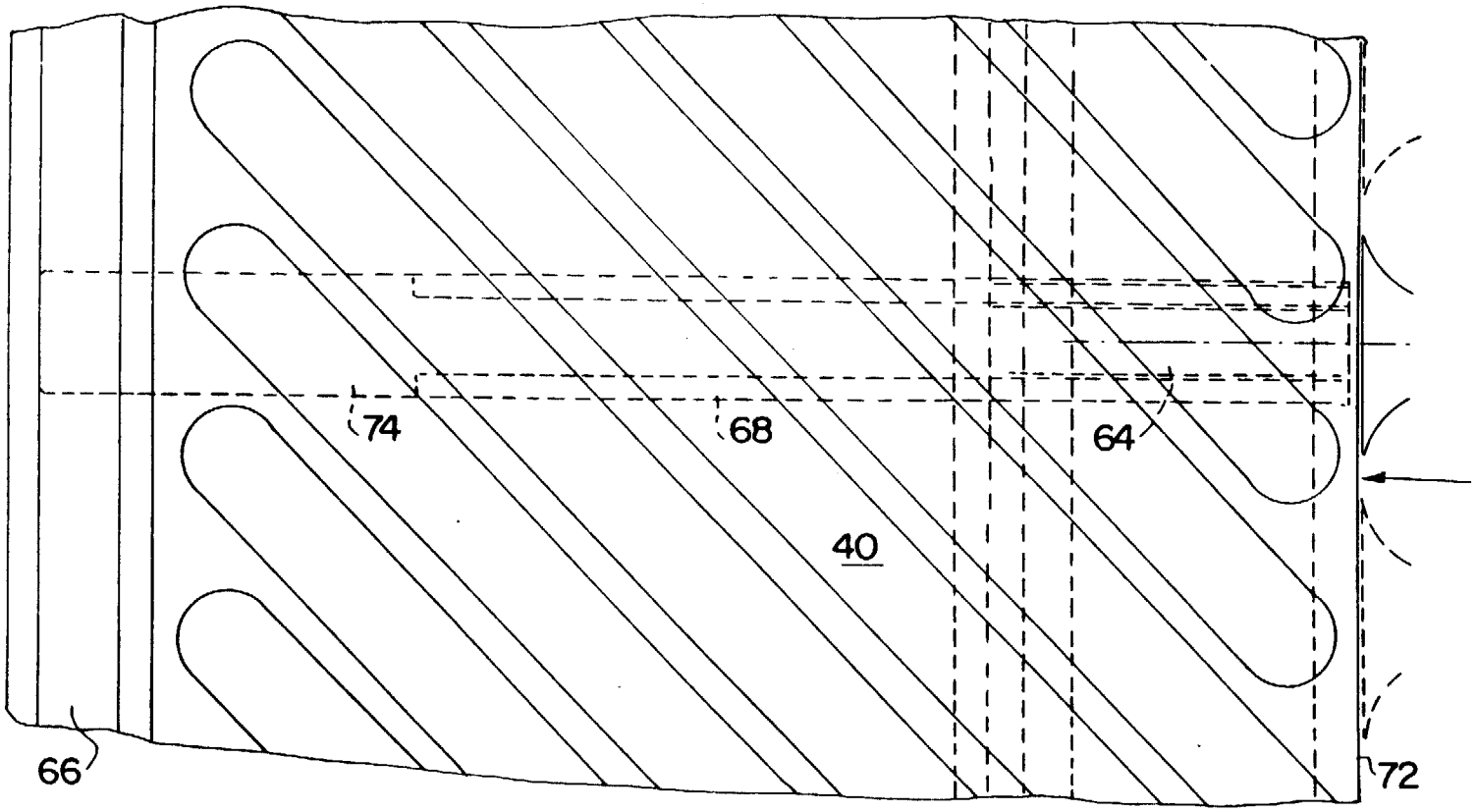
FIG. 6 is a partial top view of the cover plate to illustrate the guide.

FIG. 6 is a partial top view of cover plate half 40 and shows in dashed lines the guide rail 68 and the guide member 64. On the left in FIG. 6, the convexly curved section 66 of the cover plate half can be seen while on the right side, the edge of the sink marked 72 is visible. The guide member 64 starts directly at this edge 72 and extends only over a short section in the longitudinal direction of the sink. In contrast thereto, guide rail 68 extends over the entire length of cover plate half 40 but is no longer undercut in its outer end section 74 shown on the left in FIG. 6. The result is that, if the cover plate half is pushed completely to the right into the position in which the sink is closed, it is possible to lift it upwardly away from guide member 64. In this position, the cover plate half can also be attached again. The removal feature is not provided for normal use but may be needed from time to time for cleaning purposes or for other reasons.

Figure 7:
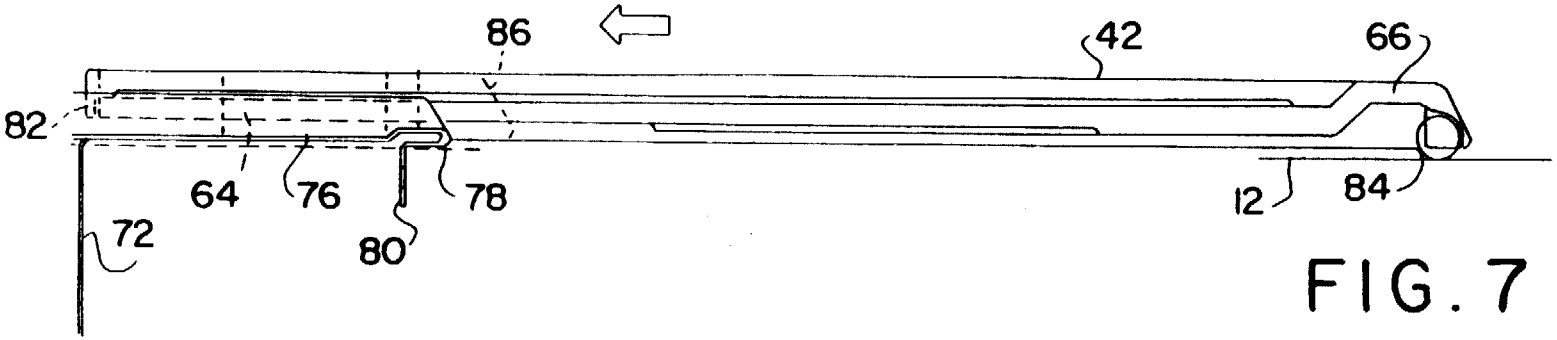
FIG. 7 is a longitudinal sectional view of the cover plate.

Additionally, FIG. 6 shows dashed lines extending vertically from the top to the bottom, whose meaning will be explained below in connection with FIG. 7 and with respect to the right cover plate half 42. An edge strip 76 which passes over counter top 12 starts at the edge 72 of the sink. The outer edge 78 of the edge strip is bent over and is provided with a downwardly oriented fastening flange 80 which engages in a cutout of the counter top that is not illustrated in detail here. Guide member 64 is attached to edge strip 76. Guide member 64 simultaneously forms an abutment on both sides for the two end positions of the cover plate halves. FIG. 7 shows that a downwardly oriented edge 82 of cover plate half 42 grips behind guide member 64 on the side of the sink, that is, on the left in FIG. 7. In the left end position of cover plate half 42, a roller 84 which facilitates displacement and is mounted below the outer convexly curved section 66 abuts against the guide member. The dashed line 86 illustrates the pushed-together end position of the cove plate half.

In the closed state, the built-in sink has a very short length of, for example, only 60 or 75 cm. Once the cover plate halves are extended, it reaches a length of 110 and 125 cm, respectively, in this case. As is apparent from the drawings, the cover plates 40, 42, are longer than the sink in the longitudinal direction of the sink and, in the closed position, cover the sink and the guide members 64.

The selection between two garbage chutes 28, 30 according to FIG. 1 or three garbage chutes 48, 50, 52 according to FIG. 3 may be left to the customer in that the chutes ar configured as interchangeable inserts. Preferably, the garbage chutes have slightly downwardly outwardly sloped side walls which prevent or restrict the sticking of garbage. As evident from a comparison of FIGS. 1 and 3, the same garbage cans can be employed independently of the number of garbage chutes, in that the rectangular cross section garbage cans are attached on pull-out 34, 54 either in the longitudinal direction or in the transverse direction.

I claim:

1. A built-in sink unit comprising:

a wash basin;

a faucet assembly mounted on said wash basin;

a garbage chute mounted near to said wash basin;

guide means mounted near said wash basin, faucet assembly and garbage chute;

a cover plate member having first and second cover plate halves movably mating with said guide means; said first and second cover plate halves being movable between a first closed position in which said cover plate halves are adjacent each other and cover said wash basin and garbage chute, and a second open position in which said cover plate halves are spaced from each other so as to expose said wash basin and garbage chute; and means defining a mating corresponding recess in each one of said first and second cover plate halves, each said recess being configured for mating with the other said recess to surround a part of said faucet assembly when said cover plate halves are in said first closed position.

2. A built-in sink unit as defined in claim 1, wherein each one of said first and second halves is configured as a drip surface.

3. A built-in sink unit comprising:

a wash basin;

a garbage chute mounted near said wash basin;

a pair of guide means, each including an elongated guide member extending in the longitudinal direction of said sink unit, one of said guide means being mounted near said wash basin and the other of said guide means being mounted near said garbage chute; and a cover plate member having first and second cover plate halves each having an elongated guide rail mating with the respective guide member, said guide rails having means for detachably engaging said guide members; said first and second cover plate halves being movable between a first closed position in which said cover plate halves are adjacent each other covering said wash basin and garbage chute and in which said guide rails are disengaged from said guide members, and a second open position in which said cover plate halves are spaced from each other so as to expose said wash basin and garbage chute and in which said guide rails are engaged with said guide members.

4. A built-in sink unit as defined in claim 3, wherein said first and second cover plate halves are longer than said wash basin in the longitudinal direction of said sink unit.

5. A built-in sink unit as defined in claim 3, further comprising a pair of outwardly extending edge strips mounted respectively near said garbage chute and said wash basin; said guide members being attached to said edge strips.

6. A built-in sink unit as defined in claim 3, wherein each of said guide members comprises a sole guide member which is centrally located on each one of said first and second cover plate halves.

* * * * *